US011390488B2

(12) United States Patent
Miriyala et al.

(10) Patent No.: US 11,390,488 B2
(45) Date of Patent: Jul. 19, 2022

(54) VISUAL INSPECTION DIAGNOSTICS

(71) Applicant: Otis Elevator Company, Farmington, CT (US)

(72) Inventors: Pradeep Miriyala, Telangana (IN); Raushan Kumar, Telangana (IN); Rachit Sahgal, Telangana (IN)

(73) Assignee: OTIS ELEVATOR COMPANY, Farmington, CT (US)

( * ) Notice: Subject to any disclaimer, the term of this patent is extended or adjusted under 35 U.S.C. 154(b) by 13 days.

(21) Appl. No.: 16/952,677

(22) Filed: Nov. 19, 2020

(65) Prior Publication Data

US 2021/0403283 A1 Dec. 30, 2021

(30) Foreign Application Priority Data

Jun. 26, 2020 (IN) ..... 202011027220

(51) Int. Cl.

| | |
|---|---|
| ***B66B 5/00*** | (2006.01) |
| ***B66B 3/00*** | (2006.01) |
| ***B66B 25/00*** | (2006.01) |
| ***B66B 27/00*** | (2006.01) |

(52) U.S. Cl.

CPC ..... *B66B 5/0025* (2013.01); *B66B 3/002* (2013.01); *B66B 5/0087* (2013.01); *B66B 25/006* (2013.01); *B66B 27/00* (2013.01)

(58) Field of Classification Search

CPC ..... B66B 29/00; B66B 29/005; B66B 5/0025; B66B 3/002; B66B 5/0087; B66B 25/006; B66B 27/00

USPC ..... 198/323

See application file for complete search history.

(56) References Cited

U.S. PATENT DOCUMENTS

| | | | | |
|---|---|---|---|---|
| 2005/0088520 | A1* | 4/2005 | Wiesinger et al. | H04N 7/18 |
| 2018/0208441 | A1 | 7/2018 | Yamada et al. | |
| 2020/0102188 | A1* | 4/2020 | Holey et al. | B66B 5/0025 |
| 2020/0122974 | A1 | 4/2020 | Yang | |

FOREIGN PATENT DOCUMENTS

| | | | | |
|---|---|---|---|---|
| CN | 111606176 | * | 4/2020 | B66B 29/00 |
| EP | 3459889 | * | 3/2019 | B66B 5/00 |
| WO | 2006/018883 | * | 2/2006 | B66B 3/00 |
| WO | 2010/121629 | * | 10/2010 | B66B 29/00 |
| WO | 2020012608 A1 | | 1/2020 | |

OTHER PUBLICATIONS

Search Report issued in European Patent Application No. 20215132.0; Application Filing Date Dec. 17, 2020, dated Jun. 18, 2021 (7 pages).

* cited by examiner

*Primary Examiner* — James R Bidwell
(74) *Attorney, Agent, or Firm* — Cantor Colburn LLP

(57) ABSTRACT

A passenger conveyor diagnostic system includes a processor that stores at least one visual inspection diagnostic, and a passenger conveyor system including at least one sensor configured to capture one or both of an image and a sound. The processor applies the at least one visual inspection diagnostic to one or both of the image and the sound to generate a diagnosed status of the passenger conveyor system, and overlays the diagnosed status of the passenger conveyor system on the image.

20 Claims, 10 Drawing Sheets

VISUAL INSPECTION DIAGNOSTICS

CROSS-REFERENCE TO RELATED APPLICATIONS

This application claims the benefit of Indian Application No. 202011027220 filed Jun. 26, 2020, which is incorporated herein by reference in its entirety.

BACKGROUND

The present disclosure relates generally to passenger conveyor systems, and more particularly, to passenger conveyor maintenance and operational diagnostics.

Service providers of passenger conveyor systems such as elevator systems, escalator systems, etc., for example, typically rely on user complaints to alert of an existing malfunction or fault before the necessary components are repaired or replaced. Not only must the system to be taken off-line at unscheduled times because it is not known when a component or system will malfunction, but one or more follow-up visits are often required once the problem is identified in order to acquire ride quality data for accurate diagnosis. In addition, diagnosis and monitoring of passenger conveyor systems before and after component faults are identified requires access to circuitry, control boxes, drive systems, or components that may be hidden behind various panels or otherwise out of sight during normal operation. Accessing the circuitry, control boxes, drive systems, or other components may also require that the system be taken out-of-service to provide a technician access to the necessary components.

SUMMARY

According to a non-limiting embodiment, a passenger conveyor diagnostic system includes a processor that stores at least one visual inspection diagnostic, and a passenger conveyor system including at least one sensor configured to capture one or both of an image and a sound. The processor applies the at least one visual inspection diagnostic to one or both of the image and the sound to generate a diagnosed status of the passenger conveyor system, and overlays the diagnosed status of the passenger conveyor system on the image.

According to another non-limiting embodiment, a mobile terminal device is configured to diagnose a passenger conveyor system. The mobile terminal device comprises a memory unit that stores a visual inspection application configured to perform at least one visual inspection diagnostic, and a network interface device that establishes communication with at least one sensor installed on the passenger conveyor system. The mobile terminal device further includes an electronic hardware controller that applies the at least one visual inspection diagnostic to one or both of images and a sounds obtained from the at least one sensor to determine at least one diagnostic result of the passenger conveyor system, and displays the image with the least one diagnostic result overlaid thereon.

According to still another non-limiting embodiment, a method is provided to diagnose a passenger conveyor system. The method comprises storing, via a processor, at least one visual inspection diagnostic, and capturing, via at least one sensor installed on the passenger conveyor system, one or both of an image and a sound. The method further comprises applying, via the processor, the at least one visual inspection diagnostic to one or both of the image and the sound to generate a diagnosed status of the passenger conveyor system. The method further comprises overlaying, via the processor, the diagnosed status of the passenger conveyor system on the image.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application. For example, "about" can include a range of ±8% or 5%, or 2% of a given value.

Figure 1:
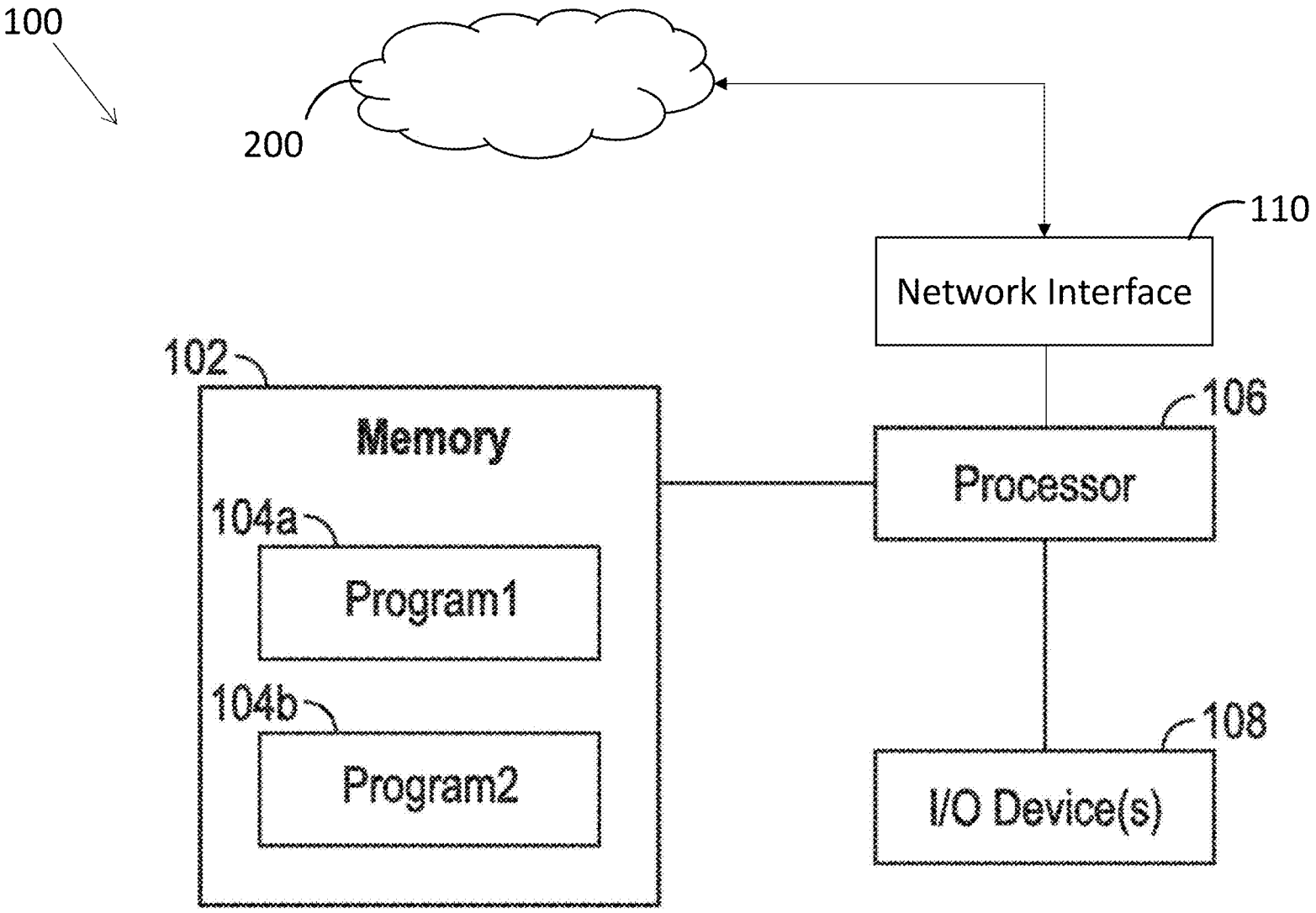
FIG. 1 is a block diagram of a computing system according to a non-limiting embodiment.

With reference now to FIG. 1, a computing system 100 capable of performing one or more embodiments of the invention is illustrated according to a non-limiting embodiment. The computing system 100 includes a memory 102 and an electronic hardware processor 106. The memory 102 stores various instructions algorithms which are executable by the processor 106. The executable instructions can be stored or organized in any manner and at any level of abstraction, such as in connection with one or more processes, routines, procedures, methods, functions, etc. As an example, at least a portion of the instructions are shown in FIG. 1 as being associated with a first program 104*a* and a second program 104*b*.

The processor 106 also includes one or more input/output (I/O) devices 108. In some embodiments, the I/O device(s) 108 may include one or more of a keyboard or keypad, a touchscreen or touch panel, a display screen, a microphone, a speaker, a mouse, a button, a remote control, a joystick, a printer, a telephone or mobile device (e.g., a smartphone), etc. The I/O device(s) 108 may be configured to provide an interface to allow a user to interact with the system 100.

The computing system 100 further includes a network interface 110 capable of electrically communication with a cloud computing network 200, or any other remote network. The network interface 110 includes any communication device (e.g., a modem, wireless network adapter, etc.) that operates according to a network protocol (e.g., Wi-Fi, Ethernet, satellite, cable communications, etc.) which establishes a wired and/or wireless communication with the cloud computing network 200.

The computing system 100 is illustrative as an example. In some embodiments, one or more of the entities may be optional. In some embodiments, additional entities not shown may be included. For example, in some embodiments the computing system 100 may be associated with one or more networks, such as one or more computer or telephone networks. In some embodiments, the entities may be arranged or organized in a manner different from what is shown in FIG. 1.

Figure 2:
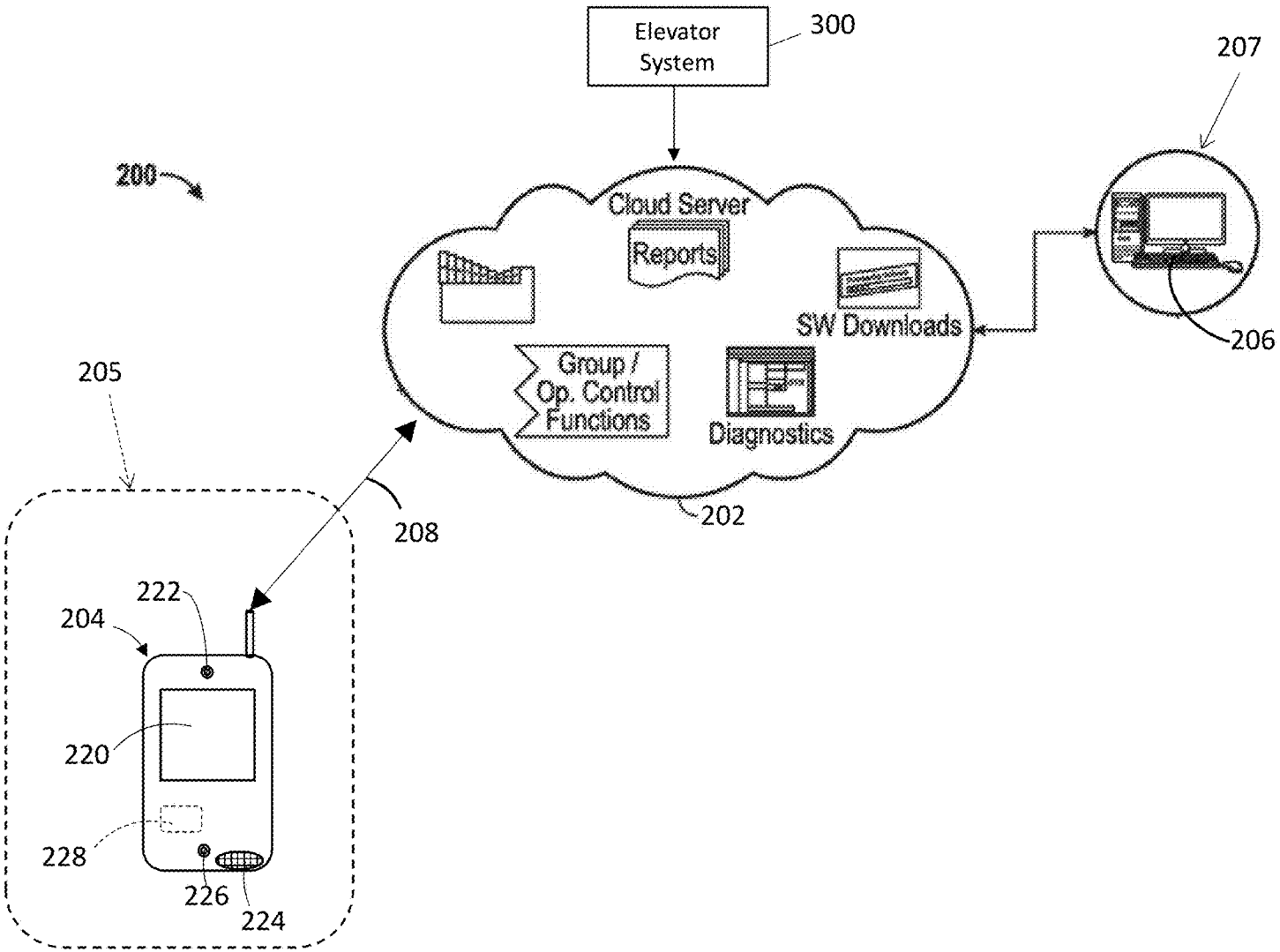
FIG. 2 illustrates a cloud computing network according to a non-limiting embodiment.

Turning now to FIG. 2, a cloud computing network 200 capable of performing one or more embodiments of the invention is illustrated according to a non-limiting embodiment. The cloud computing network 200 includes a cloud server 202, one or more mobile terminal devices 204, and one or more backend computers 206.

The cloud server 202 can store setup parameters for select functions. In some embodiments, the setup parameters can be stored in a controller. In some embodiments, there may be a simplified failover functionality located in the controller in the event that there is a connection loss between the controller and the cloud server 202.

In some embodiments, operational data and metrics may be collected and stored at a cloud server 202 across a portfolio of multiple units, sites, or groups. The data and metrics can include, but are not limited to, captured images, sounds and/or measurements. The cloud server 202 can also store various models, algorithms, software programs, prestored images and/or sounds, which can be utilized together with the collected data and metrics to perform analysis operations by the backend computer 206. For example, the backend computer 206 includes a processor configured to perform an analysis on the captured images and/or sounds, which may indicate trends and may be used to respond to needs (e.g., product needs or functionality needs). The analysis may also be used to facilitate diagnostic or troubleshooting capabilities. Metrics may be used to trigger or enhance the accuracy of sales proposals. Metrics may be used to provide or schedule maintenance activities, such as preventative maintenance activities. In some embodiments, interface protocols configured to operate with new devices, for example, may be stored in a cloud server 202 and used by a local controller. It should be appreciated that the computer 206 or processor performing the operations described above can be performed in the cloud network 200 or locally on the mobile terminal device 204.

In some embodiments, functional upgrades for diagnostics, prognostics, and remote repair/rescue functions can be deployed to customers as they are released and deployed into a cloud server 202. Functionality may be developed at the backend computer 206 (installed at a server location 207 remotely located from the mobile terminal device 204) and deployed to the cloud server 202. One or more tests may be executed to ensure that the functionality satisfies operational or safety requirements.

The mobile terminal device 204 is capable of communicating with the cloud server 202 over one or more connections, channels, or links facilitated by a network interface. The mobile terminal device 204 includes a smartphone 204, for example, which can be located in or near a passenger conveyor location 205, and is capable of electrically communicating with the cloud server 202 via a connection 208. The connection 208 can adhere to one or more communication protocols, standards, or the like. For example, the connection 208 can adhere to telephone, cellular, Wi-Fi, Ethernet, satellite, Bluetooth, Zigbee, zWave, cable communications, or any other known communication method. In some embodiments, the connection 208 may be constant or persistent. Although the mobile terminal device 204 will be referred to as a smartphone 204 hereinafter, the mobile terminal device 204 can include any mobile device capable of facilitating interaction between one or more stored software applications (i.e., apps) and the cloud server 202. For example, the mobile terminal device 204 can also include a computer tablet, a laptop computer, a smart watch, etc.

The smartphone 204 includes a display 220, and one or more sensors. The sensors include, but are not limited to, one or more cameras 222, a speaker 224, a microphone 226, and an accelerometer 228. The camera 222 is capable of capturing still images and/or moving images, which the smartphone 204 can reproduce on the display 220. The speaker 224 outputs sound from the smartphone 204 to an external environment. The microphone 226 captures sounds and noise present in the vicinity of the smartphone 204. The captured noise can be recorded to memory and reproduced via the speaker 224. The accelerometer 228 may be constructed as a single-axis or and multi-axis accelerometer, and is capable of detecting magnitude and direction of smartphone's proper acceleration, as a vector quantity. The accelerometer 228 can sense the orientation of the smartphone 204, coordinate acceleration, vibrations, shock, and movements.

As described above, functionality may be (re)located to a cloud server (e.g., cloud server 202). In terms of elevator systems, for example, such functionality may include dispatch functions for one or more passenger conveyor devices, mobile terminals, operational mode determinations, diagnostic functions, special contract features, etc. Regarding dispatch functions, in some embodiments a user request for service received at, e.g., a hall box located on a particular floor of a building may be communicated to the cloud server and the cloud server may transmit a command that directs a specified elevator car to relocate to that particular floor to fulfill the service request.

In some embodiments, a local controller (not shown) can maintain some functionality, and as such, may include hardware and computing resources to support such functionality. The controller can include hardware and/or software to communicate with the cloud server 202. For example, the controller can exchange data and commands with the cloud server 202 to perform control functions.

Figure 3:
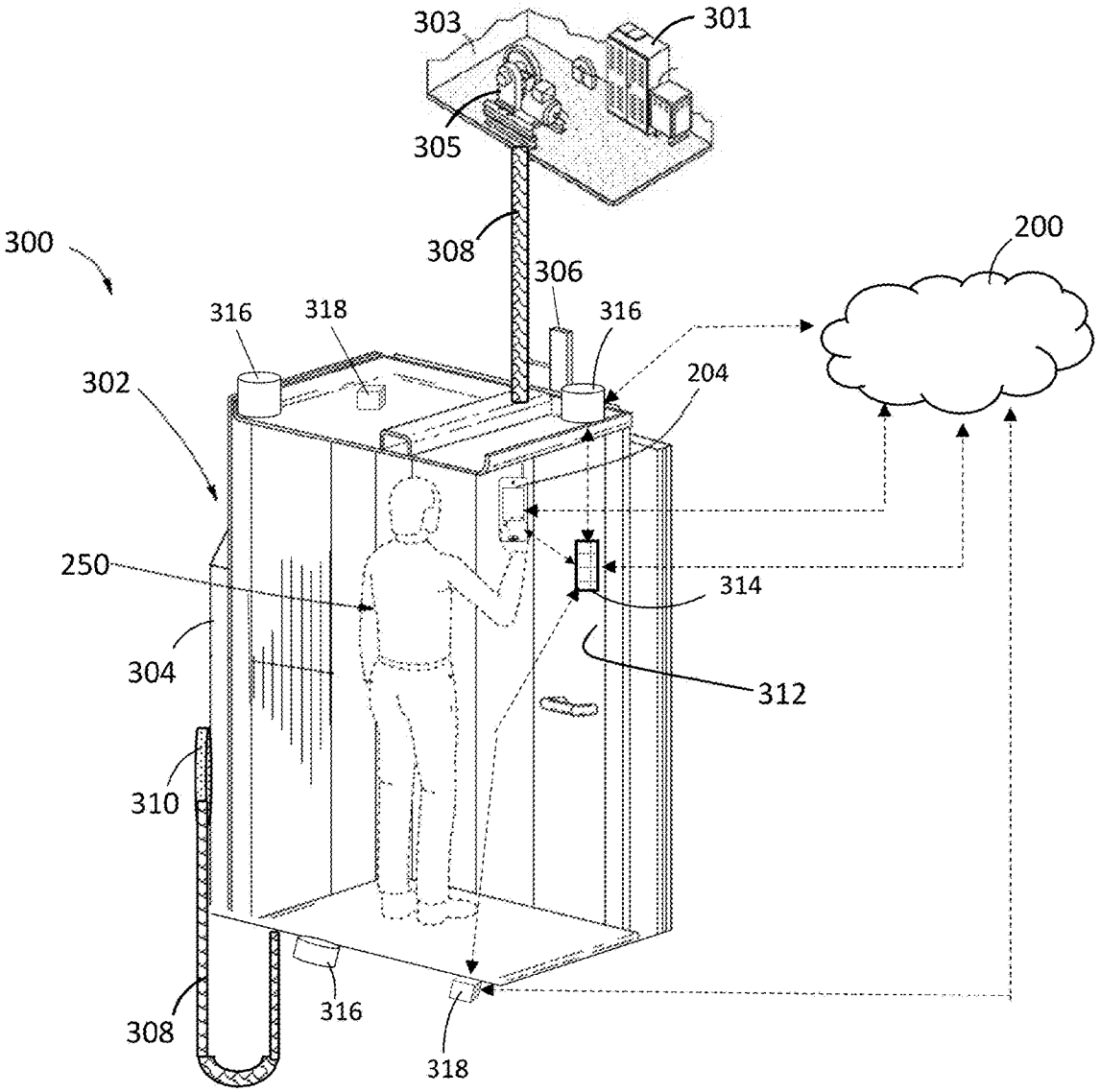
FIG. 3 illustrates a mobile terminal device installed with a visual inspection software application operating in the vicinity of an elevator system according to a non-limiting embodiment.

Turning now to FIG. 3, a mobile terminal device 204 installed with a visual inspection software application operating in the vicinity of an elevator system 300 is illustrated according to a non-limiting embodiment. Although a particular elevator system 300 is illustrated and described in the disclosed embodiment, other configurations and/or systems, such as machineroomless, ropeless or hydraulic systems are within the scope of the present invention. In addition, it should be appreciated that the smartphone 204 can operate in conjunction with other types of passenger conveyor systems including, but not limited to, an escalator system, a moving walkway system, etc., without departing from the scope of the invention.

The elevator system 300 includes a machine 301 that drives an elevator car 302 positioned in a vertical hoistway (not shown). One or more elevator car rails 304 and guides 306 are attached to the hoistway walls. The elevator system 300 further includes one or more elongated hoists 308 which couple the elevator car 302 to a counterweight (not shown). In at least one embodiment, the elongated hoists 308 can be formed as ropes, cables or belts 308 configured to support the weight of the elevator car 302 and the counterweight so as to propel the elevator car 302 in a desired direction (e.g., up or down) within the hoistway. Although a single hoist 308 is shown, it should be appreciated that additional hoists 308 may be implemented without departing from the scope of the invention.

The elevator machine 301 is installed in a machine room 303 located remotely from the elevator car 302. The elevator machine 301 controls a traction sheave 305 that rotates and causes movement of the hoists 308 to drive the elevator car 302 in a selected direction. The elevator system 300 further includes one or more deflector or idler sheaves 310 to assist in guiding the movement of various traction hoists 308. In this manner, the elevator car 302 can be driven to one or more landings or floors vertically arranged with respect to one another. Accordingly, the elevator car 302 can be driven to a requested floor, where passengers can then enter or exit the car 302 via the elevator doors 312.

The elevator car 300 can include a car controller 314 and one or more sensors 316 and 318. The car controller 314 may be in signal communication with the cloud computing network 200 and/or the mobile terminal device 204 as described in greater detail below. In this manner, the car controller 314 can facilitate data exchange between the mobile terminal device 204 and the cloud computing network 200 and/or the video cameras 316 and microphones 318.

The sensors include, but are not limited to, an accelerometer and vibration sensor, along with one or more video cameras 316 and one or more microphones 318. The video cameras 316 and microphones 318 are in signal communication with the cloud computing network 200. The video cameras 316 are configured to capture video frames and/or generate a video stream of the elevator car 302 and/or the area and/or components located in the vicinity of the elevator car 302. The area includes, for example, the surrounding elevator shaft, while the components include, for example, the car rails 304, guides 306, hoists 308, and sheaves 310. The microphones 318 are configured to capture sounds (e.g., vibrations, rattles, squeaking, etc.) external to the elevator car 302, sounds within the elevator car 302, and/or sounds generated by various elevator components such as, for example, the car rails 304, guides 306, hoists 308, sheaves 305, 310 and the machine 301. Although the video cameras 316 and the microphones 318 are illustrated as separate and individual sensors, it should be appreciated that a video camera 316 and a microphone 318 can be integrated together to construct a single sensor without departing from the scope of the invention.

Still referring to FIG. 3, a maintenance technician or mechanic 250 can operate the elevator car 302 while diagnosing the elevator system 300 using the mobile terminal device 204. Although the mobile terminal device 204 will be described as a smartphone, other types of mobile terminal or user equipment (UE) devices may be employed including, but not limited to, a computer tablet, a laptop computer, a smart watch, etc.

The maintenance technician 250 can operate the smartphone 204 to perform a visual inspection of the elevator system 300 without having to locate to one or more particular areas of the elevator system that may be experiencing technical issues. For instance, the smartphone 204 is installed with a visual inspection software application, and is configured to display an image or image stream overlaid with diagnostic results obtained using the visual inspection software. A technician may then analyze the image or image stream and overlaid diagnostic results to diagnose the elevator system without needing to physically locate themselves within the interior space (e.g., elevator shaft) of the elevator system.

The visual inspection software application can be executed by a processor installed on the smartphone 250 to initiate the video cameras 316 and microphones 318 and perform visual/audio inspection, along with quantitative measurements and analysis pertaining to the operation of the elevator system 300. For example, the visual inspection software application and processor work in conjunction to compare captures images and/or sounds to pre-stored images and/or sounds to diagnose the operation of the elevator system. Analytical data generated by the visual inspection software application can be stored locally on the smartphone 204 and/or can be stored in the cloud server 202. The analytical data includes, but is not limited to, machine noise, machine vibration, elevator car vibrations, rope noises, transient/travel noise, idler/deflector noises, rail and guide vibrations, and elevator door noise. The analytical data stored in the cloud server 202 and can further be archived and tracked over time to determine whether an identified problem has been resolved following a recent repair effort, or whether the problem remains or has worsened.

In one or more embodiments, the visual inspection software application sends a request to perform a visual inspection test, which is communicated to the car controller 314 and/or cloud computing network 200. In response to receiving the visual inspection test request, the car controller 314 or the cloud computing network 200 initiates the video cameras 316 and microphones 318. The initiation includes buffering memory associated with the video cameras 316 and microphones 318 before proceeding to execute the visual inspection test.

The visual inspection test request may also include a requested diagnostic operation selected by the user 250. While performing the selected diagnostic operation the video cameras 316 and microphones 318 may capture video, still images and sounds. Once the selected diagnostic operation is completed, the car controller 314 and/or the cloud computing network 200 executes the diagnostic operation selected by the user 250, while the video cameras 316 and microphones 318 capture video frames and/or sounds during the ongoing diagnostic operation. Following completion of the buffering, cloud computing network 200 and/or the visual inspection software can perform an analysis of the captured data to identify one or more abnormalities occurring during the diagnostic test. The analysis can include audio processing to identify a possible abnormality such as for example, a faulty component. In one or more embodiments, the cloud computing network 200 and/or the visual inspection software can compare an image of a component captured during the diagnostic operation to a stored image of a known normal operating component to determine whether the captured component appears normal or abnormal. Similarly, the cloud computing network 200 and/or the visual inspection software can compare sounds captured by the microphones 318 to sounds stored in memory to distinguish between normal operating components and abnormal operating components.

When an abnormality is detected, a timestamp is determined corresponding to the time period included among the video frames or during the video stream at which the abnormality occurred. The cloud computing network 200 and/or the visual inspection software then processes the corresponding captured video frames by generating a video stream and overlaying the video stream with a results graphic user interface (GUI) that displays the results of the diagnostic operation. In one or more embodiments, the results GUI can be operated in a diagnostic mode or a metrics mode. When the diagnostic mode is invoked, the results GUI overlays graphical status indicators indicating a diagnosed status of one or more given elevator system components. When the metrics mode is invoked, the results GUI overlays graphical status indicators alerting to normal or abnormal operating characteristics of the elevator system such as, for example, vibrations, maximum noise levels, average noise levels, etc. Although the diagnostic information and metric information are overlaid according to two separate results GUI modes, it should be appreciated that the results GUI can operate in a single mode to simultaneously overlay both the diagnostic information and the metric information without departing from the scope of the invention.

Figure 4:
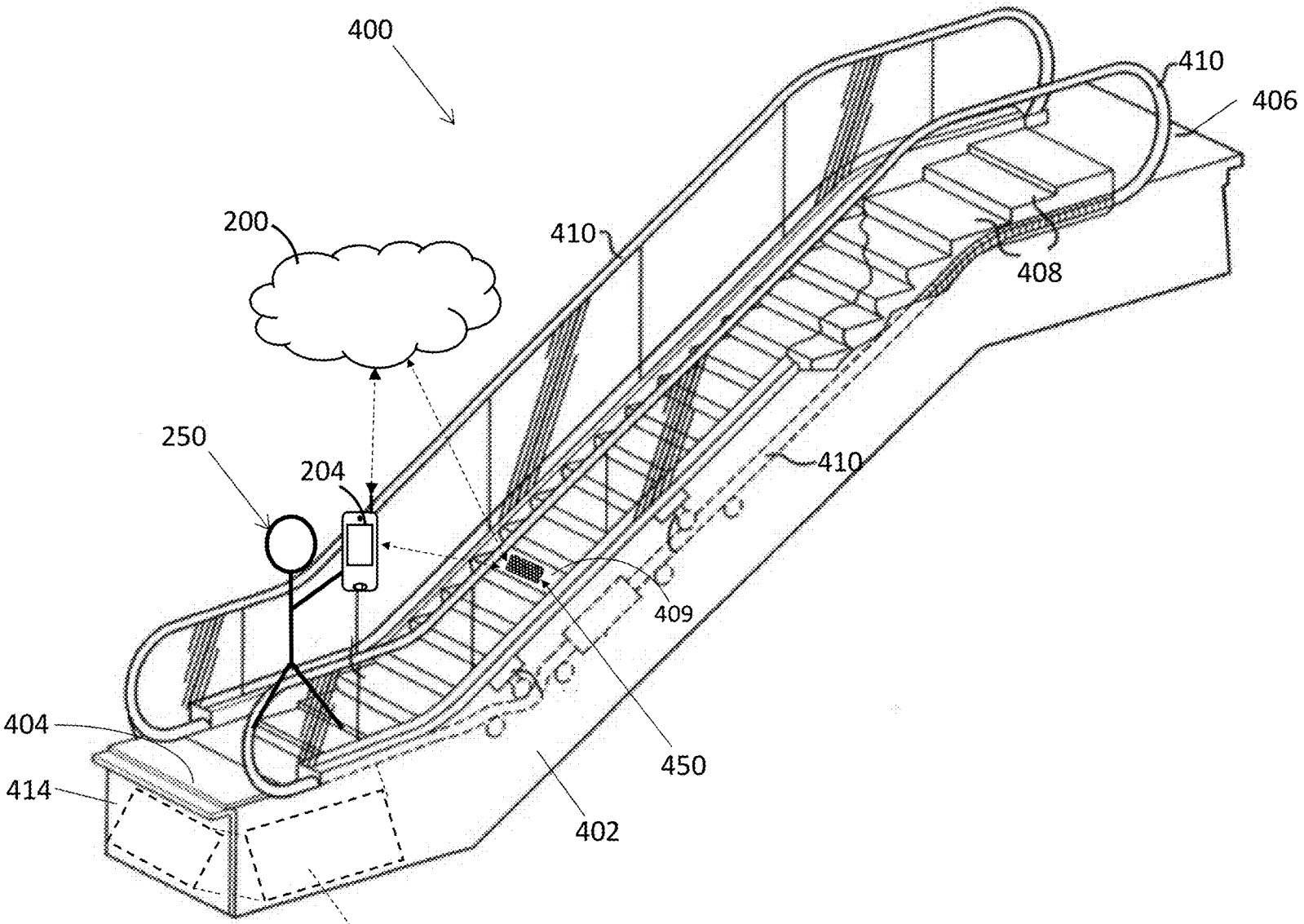
FIG. 4 illustrates a mobile terminal device installed with a visual inspection software application operating in the vicinity of an escalator system according to a non-limiting embodiment.

Turning to FIG. 4, a mobile terminal device 204 is installed with a visual inspection software application operating in the vicinity of an escalator system 400 is illustrated according to a non-limiting embodiment. The mobile terminal device 204 will be described as a smartphone 204 going forward, it can include, but is not limited to, a computer tablet, a laptop computer, smart watch, etc. The smartphone 204 includes a network interface device (not shown in FIG. 4) that facilitates data exchange between the smartphone 204 and a cloud computing network 200, or other remote computer or controller (not shown). As described herein, the network interface device includes any communication device (e.g., a modem, wireless network adapter, etc.) that operates according to a network protocol (e.g., Wi-Fi, Ethernet, satellite, cable communications, etc.) which establishes a wired and/or wireless communication with the cloud computing network 200, remote controller, and/or remote controller.

The escalator system 400 includes a truss 402 extending between a lower landing 404 and an upper landing 406. A plurality of sequentially connected treadplates or steps 408 are connected to a drive chain (not shown) and travel through a closed loop path within the truss 402. A pair of handrails 410 are coupled to the truss 402 and are located at opposing sides of the steps 408. The handrails 410 move along with the steps 408 to provide passenger support. A machine 412 drives the steps 408 and handrails 410. The machine 412 is typically located in a machine space 414 under one of the landings e.g., contained within the lower landing 404.

In one or more non-limiting embodiments, the escalator system 400 can include a diagnostic system 450. The diagnostic system 450 can be integrated in one or more steps 408 of the escalator system 400 so as to provide a diagnostic step 409. In some embodiments, the diagnostic step 409 can be implemented as a fixed component of the escalator system 400. In other embodiments, the diagnostic step 409 can replace a standard escalator step 408 to facilitate diagnostic operations of the elevator system 400. Once the diagnostic operations are completed the diagnostic step 409 may optionally be removed and replaced with the standard step 408.

The diagnostic system 450 can include at least one camera (not shown), at least one microphone (not shown), various sensors (e.g., an accelerometer, vibration sensor, etc.) and a step controller (not shown) all which are integrated within the diagnostic step 409. The step controller includes a network interface as described herein. Accordingly, the diagnostic system 450 included in the diagnostic step 409 can wirelessly communicate with the cloud computing network 200 and/or the smartphone 204, e.g., via the step controller.

The camera is configured to capture images of the escalator interior space (e.g., the interior space of the escalator truss), while the microphone is configured to capture sounds such as vibrations, squeaks, etc. In one or more embodiments, the cameras and the microphones may collect images and/or sounds of various escalator components including, but not limited to, the handrail drive system, tracking system and/or or sprocket wheels. Further, the cameras and microphones can capture the images and/or sounds as the diagnostic step 409 travels along the track of the escalator system 400, thereby collecting diagnostic data (e.g., images and/or sound) at various locations. A more detailed description of the diagnostic step 409 implementing the diagnostic system 450 is described in U.S. Patent Application Publication 2018/0208441, which is assigned to Otis Worldwide Corp., and is expressly incorporated by reference herein in its entirety.

Still referring to FIG. 4, a maintenance technician or mechanic 250 can diagnose operation of the escalator system 400 using the visual inspection software installed in the smart phone 204 in conjunction with the diagnostic system 450 implemented in the diagnostic step 409. In this manner, the maintenance technician or mechanic 250 can visually inspect and diagnose the escalator system 400 (e.g., the interior space of the escalator truss 402) by analyzing the results GUI overlaid and video stream displayed on the smartphone 204 without physically locating themselves within the escalator system 400 (e.g. within the interior space of the escalator truss 402).

The visual inspection software application is capable of providing quantitative measurement and analysis of the escalator system 400 ride quality obtained by the smartphone 204. For example, the visual inspection software application is capable of performing real-time comparisons between actual performance of the escalator system 400 and its expected performance. Analytical data generated by the visual inspection software application can be stored locally on the smartphone 204 and/or can be stored in the cloud server of the cloud network 200. The analytical data includes, but is not limited to, machine noise, machine vibration, truss vibrations, step vibrations, step noise, handrail vibrations, handrail noise, and drive chain noise. The analytical data stored in the smartphone 204 and/or cloud server can further be archived and tracked over time determine whether an identified problem has been resolved following a recent repair effort, or whether the problem remains or has worsened.

In one or more non-limiting embodiments, the inspection software application installed on the smartphone 204 communicates with the cloud network 200 and/or the step controller, and initiates the cameras and microphones of the escalator diagnostic system 450 to capture images and sounds while executing the selected diagnostic. Following completion of the diagnostic, the camera and microphone data (e.g., captured images and sounds) is buffered, a video stream is generated, and the results GUI is overlaid on the video stream, similar to the diagnostic operations described regarding the elevator system 300 described above. In one or more embodiments, the diagnostic and/or metrics data displayed by the results GUI overlaid on the video stream can be changed based on the selected diagnostic operation. In addition, timestamps can be generated in response to detecting an anomaly during the diagnostic operation and an alert indicator can be included in the results GUI alerting the technician to the detected anomaly as described in detail above. As in the case of elevator diagnostic tests described above, the abnormal or sub-optimal noise and vibrations can be analyzed to implicate a particular product part or component. Symptoms, diagnoses and/or metrics are displayed by the results GUI, which is overlaid on the image stream generated according to the diagnostic operation as describe above with reference to the elevator system. In addition, the diagnostic data and/or metrics data displayed by the results GUI overlaid on the video stream dynamically change as the diagnostic step travels along the track to different locations of the escalator system 400.

Referring to FIGS. 5A, 5B, 5C, 5D and 5E, a smartphone 204 is illustrated operating in various modes to perform visual inspections of an elevator system according to non-limiting embodiments. As described above, the visual inspection software overlays a results GUI according to a diagnostics mode or a metrics mode as selected by the user. Each mode includes overlaying a corresponding results GUI on a video stream displayed on the display 220 of a mobile terminal, e.g., smartphone 204. Although an elevator system is described with reference to FIGS. 5A-5E, it should be appreciated that various modes of the smartphone 204 can be utilized to diagnose other types of conveyor system (e.g., an escalator) without departing from the scope of the invention.

Figure 5A:
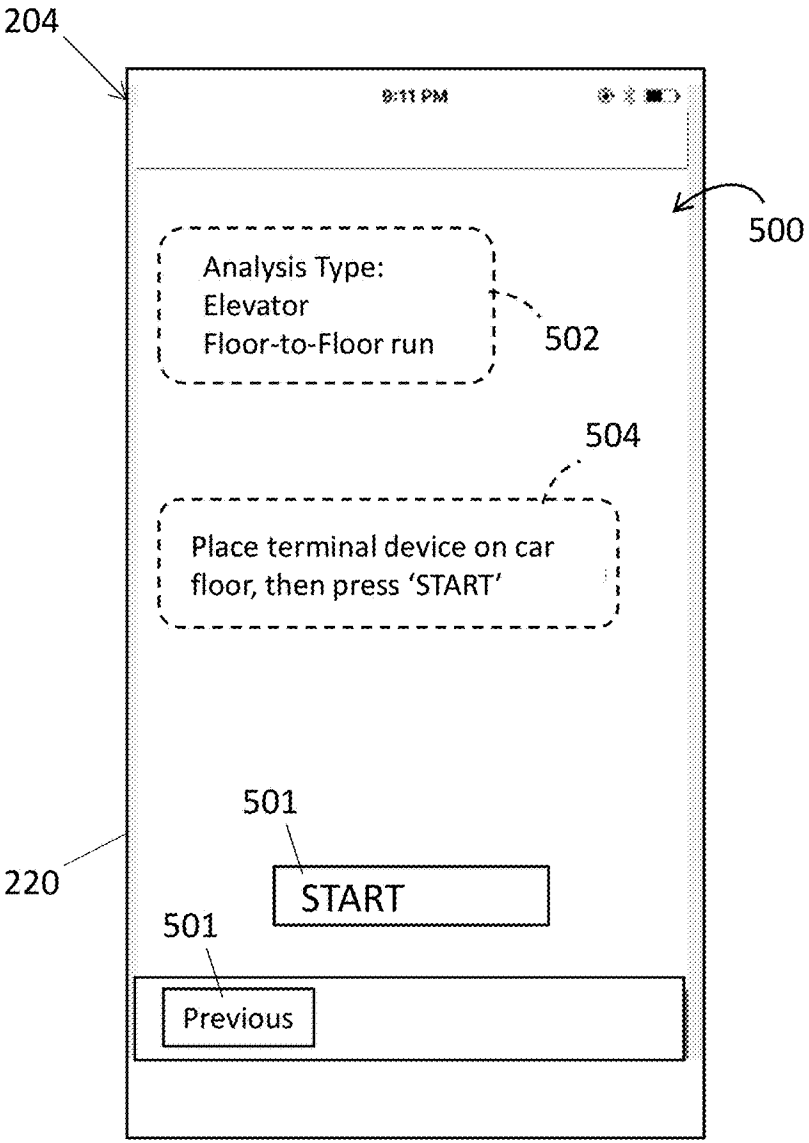
FIG. 5A illustrates a mobile terminal device displaying a home interface provided by a visual inspection software application according to a non-limiting embodiment.

Referring to FIG. 5A, the smartphone 204 is shown displaying a home GUI 500. A user can manipulate the home GUI 500 by touching a touch-screen actuator 501 displayed on the screen 220 and/or using other input actuators (not shown) installed on the smartphone 204.

The home GUI 500 includes a diagnostic selection field 502 and a user instruction field 504. The diagnostic selection field 502 allows the user to select a desired diagnostic operation among a plurality of different diagnostic operations capable of diagnosing different maintenance issues of a passenger conveyor system. In terms of an elevator system environment, for example, the various diagnostic operations include, but are not limited to, a "Door Cycle" diagnostic operation and a "Floor-to-Floor" diagnostic operation. The "Door Cycle" diagnostic test executes a testing routine to diagnose the operation of the elevator doors. The "Floor-to-Floor" diagnostic operation executes a testing routine to diagnose any abnormal or sub-optimal operation of the elevator as it travels within the building.

In terms of an escalator system environment, the diagnostic selection field 502 allows a user to select from various diagnostic operations including, but not limited to, a Machine Diagnostic, an Ascending Step Run diagnostic, a Descending Step Run diagnostic, a Full Track Run Diagnostic, a Handrail Diagnostic, and a Braking Diagnostic. The diagnostic operations are described in greater detail below.

The Machine Diagnostic operation allows for capturing noises and/or vibrations generated from within the machine space and compares the measured data to the expected range of noises and/or expected range of vibrations for that equipment.

The Ascending Step Run Diagnostic, Descending Step Run Diagnostic, and Full Track Run Diagnostic operations monitor real-time operation of the escalator system as the user rides along with the moving steps. The diagnostics during this operation include, sound detection of step and handrail noises, noises of the drive chain, vibrations of the steps, and step traveling speed.

The Handrail Diagnostic can be more specifically directed to diagnosing issues with the handrail. The diagnostics performed during the Handrail Diagnostic includes analyzing noises produced by the handrails and/or vibrations of the handrails.

The Braking Diagnostic can diagnose whether the steps of the escalator are brought to a stop in an expected amount of time following an escalator braking event. The deceleration of the steps can be compared to a threshold to determine whether the braking function of the escalator is performing as expected. The Braking Diagnostic can also diagnostic the deceleration of the steps. For example, any pulsations in the deceleration of the steps can implicate specific parts or components of the braking mechanism.

The user instruction field 504 displays diagnostic operating instructions that direct the user how to properly execute the selected diagnostic operation. The instructions include, for example, instructing a user where to locate the smartphone with respect to the user's person, along with a location with respect to the passenger conveyor system while will provide the user with most optimal results. When the "Door Cycle" diagnostic is selected, for example, the user instruction field 504 can instruct the user to "hold the phone chest high, face the landing door, and press start." The instructions presented in the user instruction field 504 can vary based on the diagnostic operation selected from the diagnostic selection field 502. For example, when performing the Door Cycle diagnostic, the instructions may instruct the user to locate the smartphone 204 near the elevator doors or near a specific component associated with the doors, whereas instructions corresponding to the Machine Diagnostic instructions will instruct the user to locate the phone within the machine space of the escalator. Similar instructions can be provided to the user when performing diagnostic operations associated with another type of passenger conveyor system such as, for example, an escalator system.

Figure 5B:
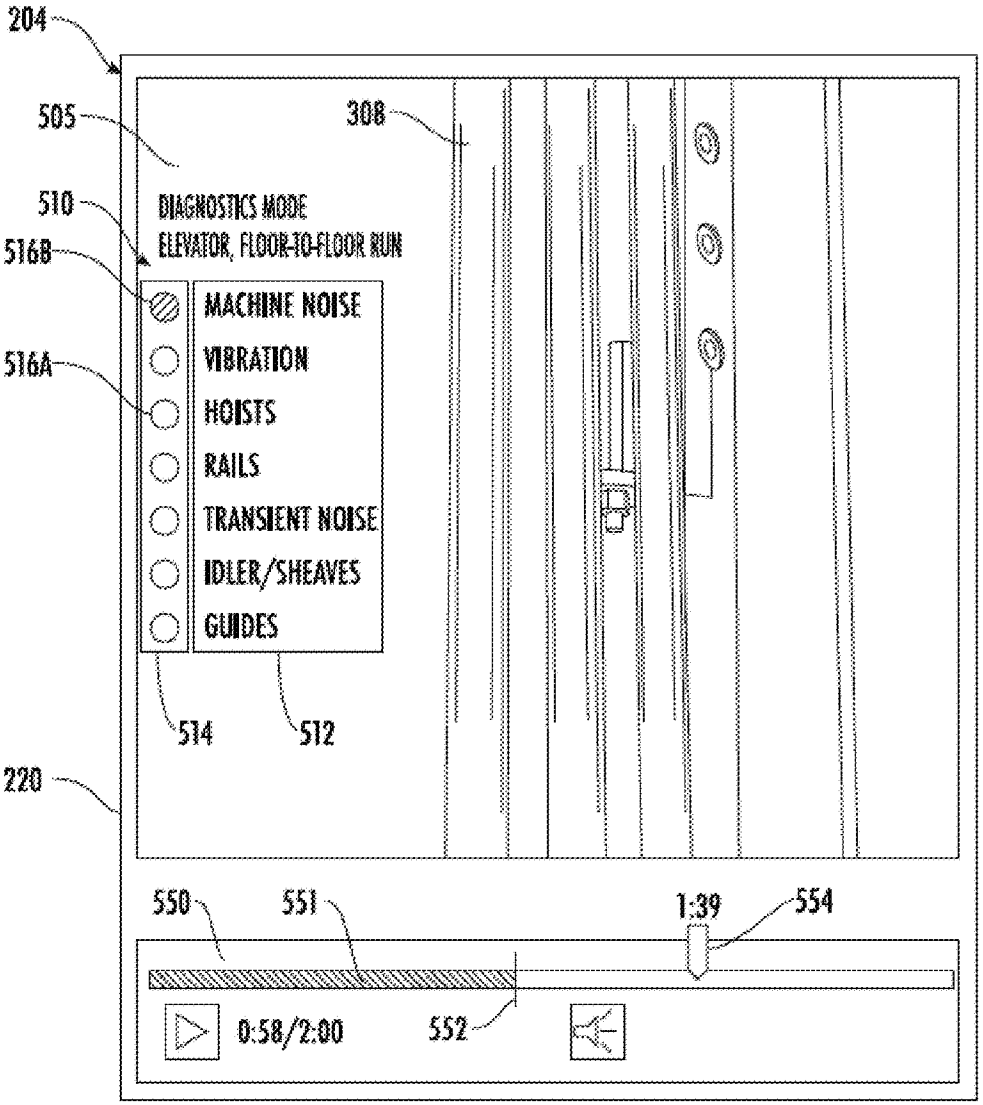
FIG. 5B illustrates a mobile terminal device executing visual inspection software that overlays a diagnostic mode interface on a first video frame showing a normal operating condition of an elevator system according to a non-limiting embodiment.
Figure 5C:
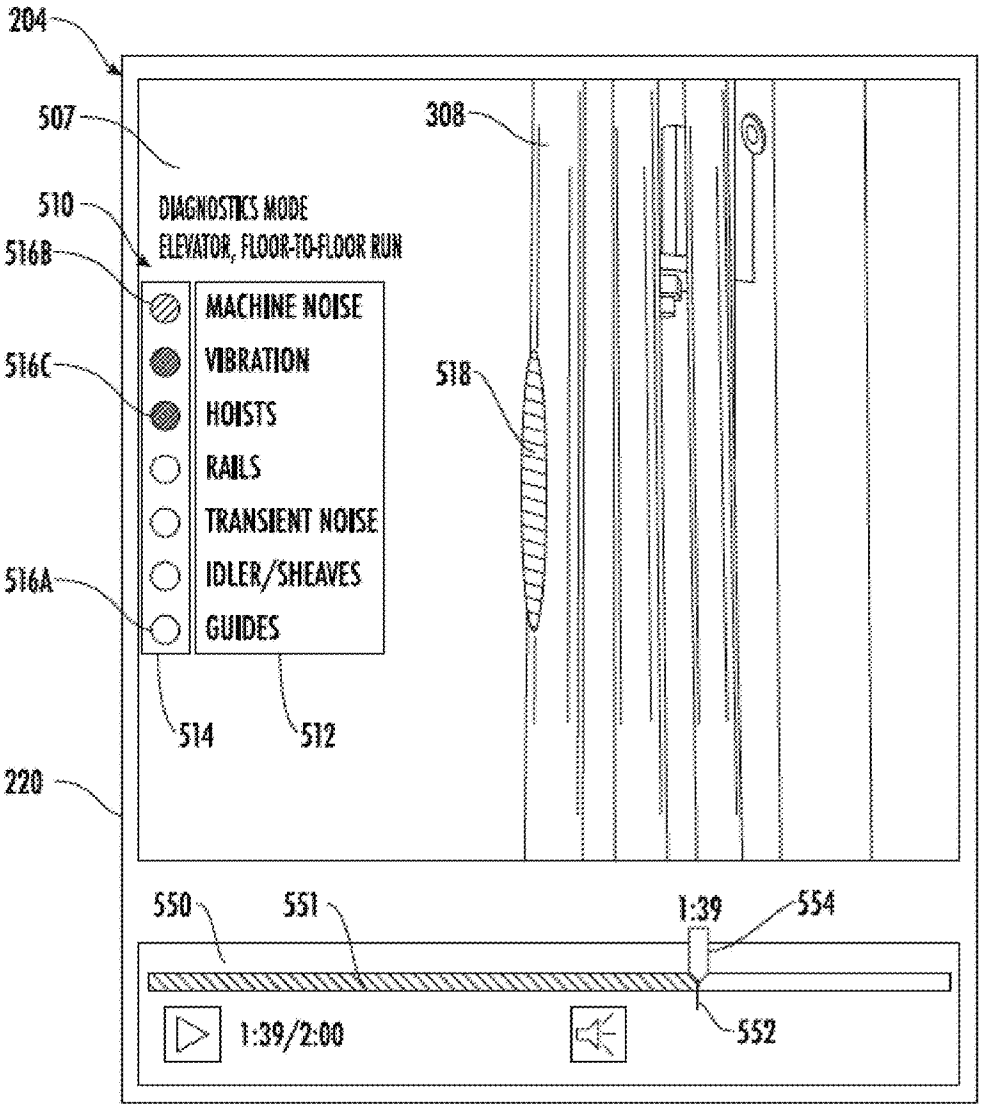
FIG. 5C illustrates the mobile terminal device executing the visual inspection software overlaying the diagnostic mode interface on a second video frame showing an abnormal operating condition of the elevator system according to a non-limiting embodiment.

Turning to FIG. 5B, the smartphone 204 is shown overlaying a diagnostic mode results GUI 510 on a first video frame 505 captured following a floor-to-floor run diagnostic operation performed by the visual inspection software. In this example, the first video frame 505 occurs at time 0:58 of the video stream and includes elevator car hoists 308 shown in a normal condition, i.e. without any detected abnormalities, defects, flaws, wear, etc.

The smartphone 204 also displays a video playback interface 550. The video playback interface 550 includes a progress bar 551 and a progress indicator 552. The progress bar 551 is indicative of a complete duration of the video stream. The progress indicator indicates the current playback duration among the complete duration of the video stream. When the video stream includes one or more defects detected following analysis of the diagnostic operation, the smartphone 204 also displays an alert indicator 554. The alert indicator 554 is displayed at the time of the video stream that corresponds to the timestamp corresponding to an abnormality detected during the diagnostic operation. In this manner, a user can move (e.g., touch and slide) the progress indicator 552 toward the alert indicator 554 to quickly reach a point in the video stream that contains the detected abnormality.

The diagnostic results GUI 510 includes a component field 512 and a status indicator field 514. The component field 512 lists one or more components that were diagnosed according to a selected diagnostic operation (i.e., the diagnostic operation selected from the home GUI 500). One or more of the displayed components can change depending on the selected diagnostic operation. For example, "ropes" and "rails" may be displayed after performing the Floor-to-Floor diagnostic operation, while "sill" and "hanger" may be displayed after performing the Door Cycle diagnostic operation. Similarly, escalator components such as "step chain" and "handrail drive chain", for example, may be displayed after performing one or more escalator system diagnostic operations.

The status indicator field 514 displays a status indicator 516*a* corresponding to each component name displayed in the component field 512. The status indicator 516*a* can be displayed with a unique identified (e.g., color, shape, etc.) which indicates a diagnosed status of the component following the diagnostic operation. For example, a first status indictor 516*a* (e.g., a green-colored graphical indicator) may indicate that the corresponding component is operating normally or as expected following the diagnostic operation. A second status indictor 516*b* (e.g., a yellow-colored graphical indicator) may indicate that although still providing suitable results, a corresponding component was detected as operating with one or more irregularities. For example, although an elevator car traveled between one or more floors with noise levels that are generally acceptable to most passengers, the noise may contain features that suggest a roller bearing is wearing and should be replaced. Therefore, the maintenance technician may monitor this unit carefully for the next several service visits.

The results GUI may be configured to dynamically (i.e., actively) change as video playback progresses through the duration of the video stream. FIG. 5B, for example, illustrates the results GUI overlaid on a second video frame 507 located at a subsequent time, e.g., 1 minute 39 seconds (1:39) of the video stream. In the second video frame 507, an abnormality 518 present on one of the hoists 308 and captured during the initial diagnostic is reproduced during playback of the video stream. An alert of the detected abnormality 518 is also indicated by the alert indicator 554 at the timestamp (e.g., 1:39) of the video stream. The results GUI 510 may also be changed to reflect the detected abnormality 518. Accordingly, the results GUI 510 now includes a third status indicator 516*c* (e.g., a red-colored graphical indicator), which indicates which components are associated with the detected abnormality. These results may include, for example, vibrations or noises that exceed a threshold level for passenger comfort. Accordingly, a technician can determine that the elevator system and/or components require further analysis or servicing without physically locating themselves to the area of the detected abnormality.

Figure 5D:
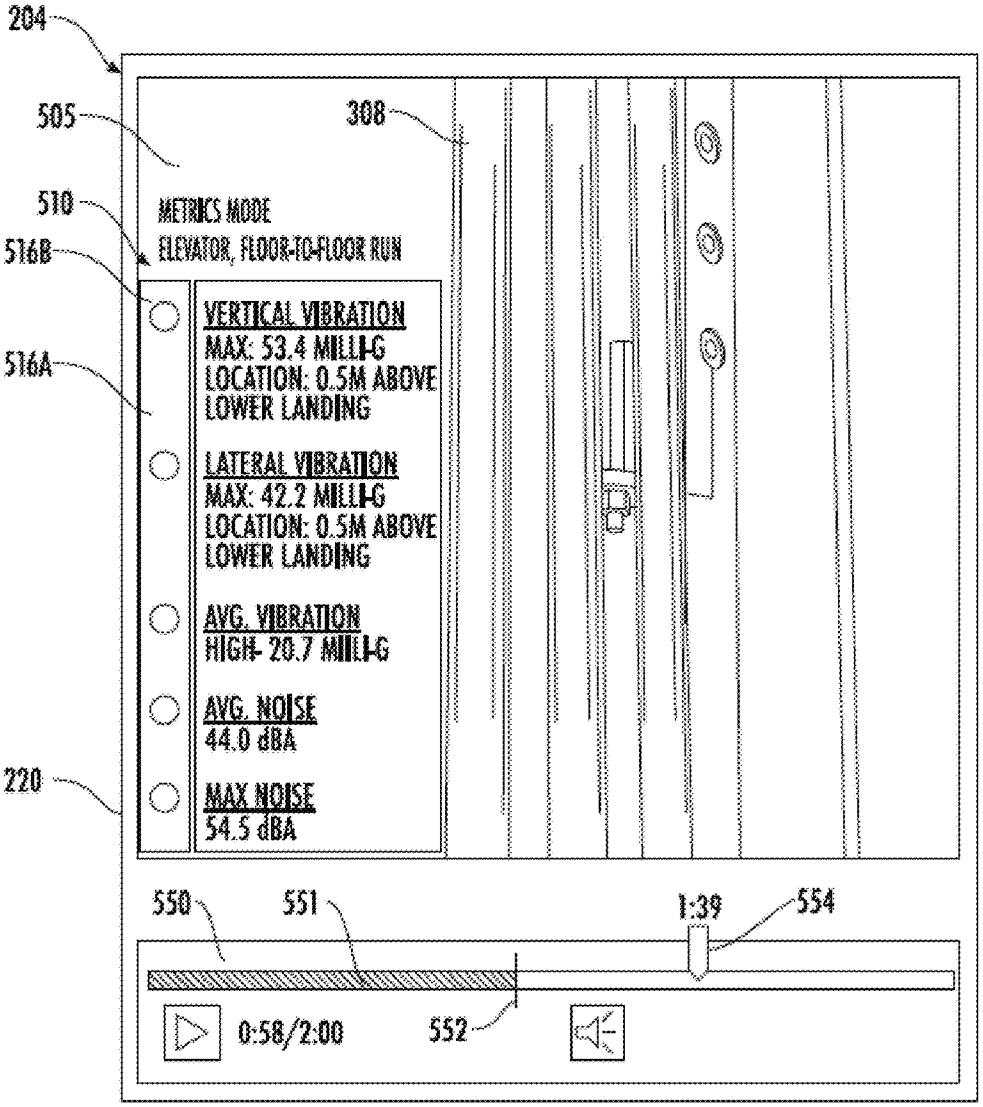
FIG. 5D illustrates the mobile terminal device executing the visual inspection software overlaying a metrics mode interface on the first video frame showing a normal operating condition of the elevator system according to a non-limiting embodiment.
Figure 5E:
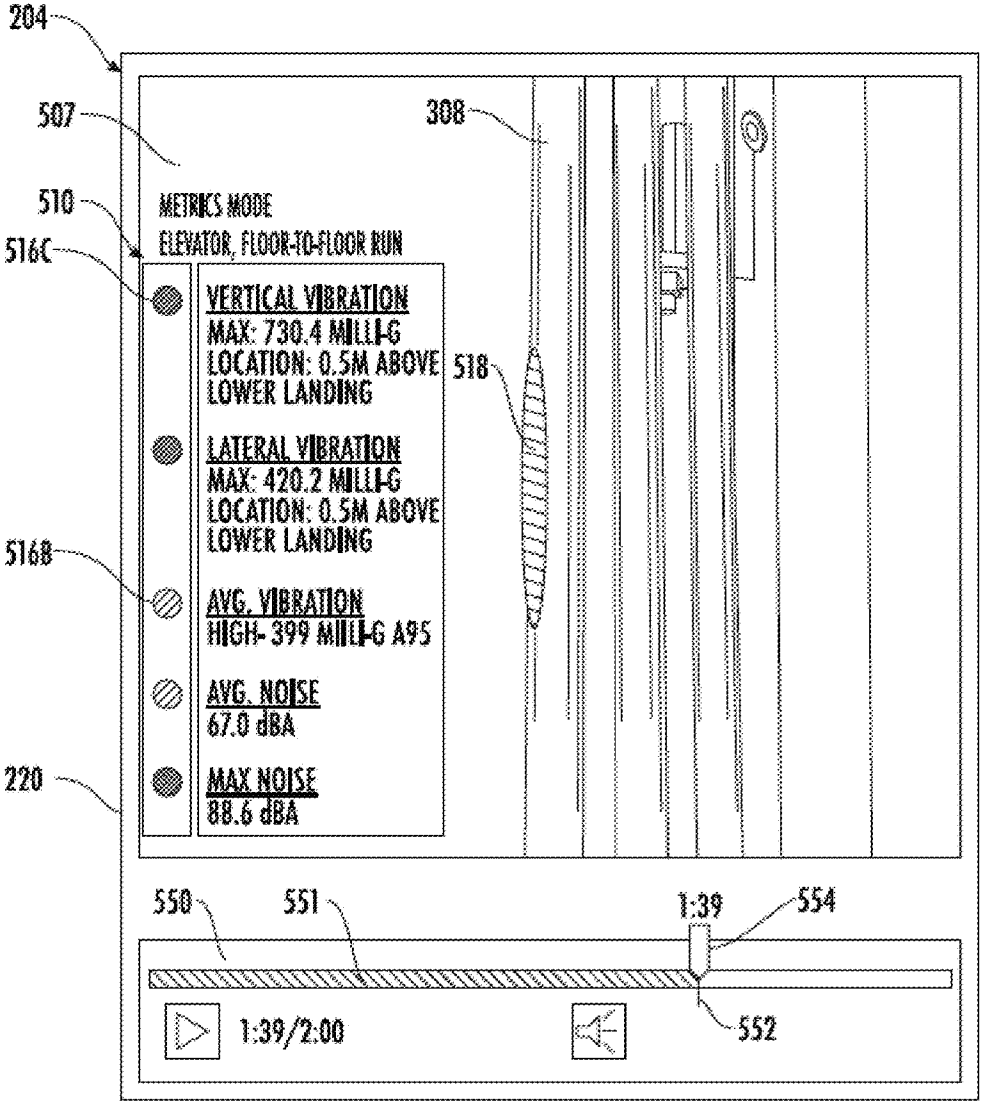
FIG. 5E illustrates the mobile terminal device executing the visual inspection software overlaying the metrics mode interface on the second video frame showing an abnormal operating condition of the elevator system according to a non-limiting embodiment.

Referring to FIGS. 5D and 5E, the overlaid results GUI 510 is illustrated operating in metrics mode. In this example, the results GUI 510 operates similar to when operating in the diagnostics mode described above. However, the information overlaid on the video stream is different. For example, FIG. 5D shows the first video frame 505 described above overlaid with the results GUI 510 operating in the metrics mode. The first video frame 505 shows the hoists 308 without any abnormalities. Accordingly, the results GUI 510 displays various measured metrics corresponding with the elevator system and associated components shown in the first video frame 505. The measured metrics may include, but are not limited to, maximum vibrations, minimum vibrations, average vibrations, maximum noise levels, minimum noise levels, and average noise levels. As described herein, the diagnostic results analysis can compare the measured metrics to various threshold values. Accordingly, when the measured metrics do not exceed a corresponding threshold value, first status indictors 516*a* (e.g., a green-colored graphical indicator) are displayed indicating that the displayed measured metrics represent expected and normal operating conditions.

Turning to FIG. 5E, the results GUI is overlaid on the second video frame 507. As described above, the second video frame 507 shows an abnormality 518 present on one of the hoists 308 previously captured by a video camera during the initial diagnostic operation. Accordingly, the displayed status indicators may be dynamically changed to reflect the dynamic changes in the measured metrics captured at the corresponding time (e.g., 1:39) of the video stream. In this example, second status indictors 516*b* (yellow-colored graphical indicators 516*b*) are displayed indicating that corresponding displayed measured metrics are approaching abnormal or unacceptable operating conditions and third status indicators 516*c* (red-colored graphical indicators 516*c*) are displayed indicating that corresponding displayed measured metrics are have exceeded abnormal or unacceptable operating conditions. In addition, the overlaid data can include location data indicating where the abnormality shown in the current video frame (e.g., the second frame 507) may be physical located in the elevator system. Accordingly, the technician can determine that the elevator system and/or components require further analysis or servicing without physically locating themselves to the area of the detected abnormality.

Figure 6:
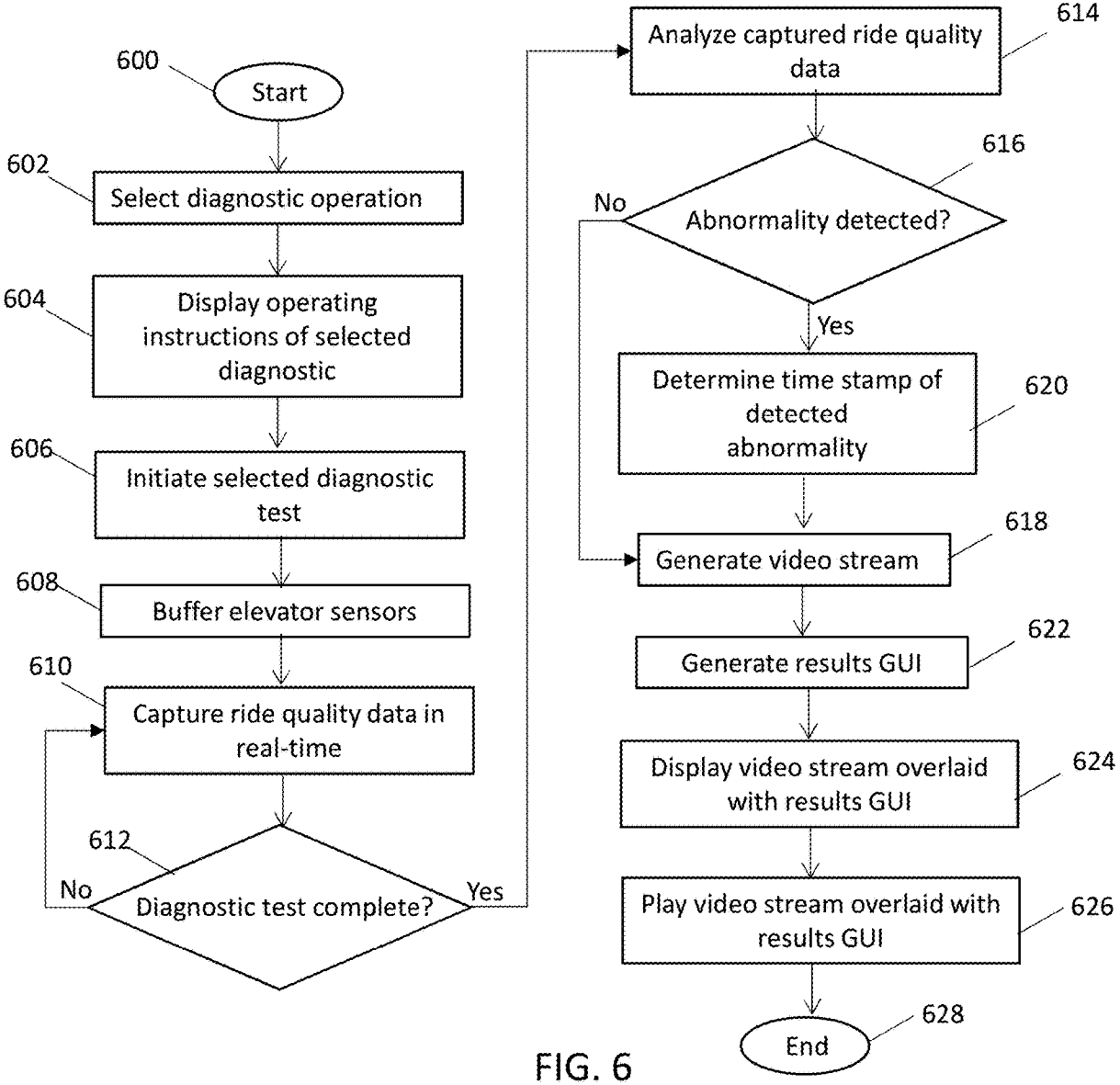
FIG. 6 is a flow diagram illustrating a method of diagnosing a passenger conveyor system using a visual inspection software application installed on mobile terminal device according to a non-limiting embodiment.

With reference now to FIG. 6, a flow diagram illustrates a method of diagnosing a passenger conveyor system using a visual inspection software application installed on an electronic mobile terminal device according to a non-limiting embodiment. The method begins at operation 600, and at operation 602 a diagnostic operation is selected among one or more available diagnostic operations. At operation 604, diagnostic operating instructions corresponding to the selected diagnostic are displayed on a screen of the mobile terminal device. At operation 606, the selected diagnostic operation is initiated, and video cameras and/or microphones are buffered at operation 608.

At operation 608, the selected diagnostic operation is performed and real-time ride quality data of the passenger conveyor system is obtained at operation 610. The ride quality data may include video frames, images, noises, sounds, and vibrations captured during the real-time operation of the passenger conveyor system during the executed diagnostic operation. At operation 612, a determination is made as to whether the diagnostic is complete. When the diagnostic operation is not complete, the method returns to operation 610 and continues capturing the real-time data.

When, however, the diagnostic operation is complete at operation 612, the method proceeds to operation 614 and analyzes the images and sounds captured during the diagnostic operation. The images and sounds and analyzed using various algorithms and processing applications. For example, real-time captured images and/or sounds can be compared to pre-stored images and sounds associated with normal operation conditions to determine whether an abnormal image or abnormal sound is present. In some examples, a vibrations and/or sounds can be compared to a threshold value to detect and abnormal condition.

At operation 616, a determination is made as to whether an abnormality is detected based, at least in part, on the analysis of the diagnostic operation results, and a video stream including the captured images and sounds is generated at operation 618. When an abnormality is detected, however, a timestamp corresponding to the detected abnormality is determined at operation 620. The timestamp includes a time period at which the abnormality occurs in the video stream.

Turning to operation 622, a results GUI is generated based, at least in part, on the analysis of the diagnostic results. At operation 624, a video stream is displayed on a display screen (e.g., on a screen of a smartphone) and the results GUI is overlaid on the video stream. When one or more abnormalities are detected at operation 616, an alert indicator based, at least in part, on a corresponding timestamp is added to a playback duration bar displayed on the display screen. At operation 626, the video stream is played (also referred as a video steam playback). Accordingly, the displayed results GUI indicates the status of the elevator system at the current playback duration of the video stream and the operation ends at operation 628.

Accordingly, various non-limiting embodiments described herein provide a visual inspection system that allows a technician to diagnose a passenger conveyor system without requiring the technician to physically locate to a specific area of the conveyor system. For instance, a technician can view a video stream overlaid with a results GUI to identify an abnormality within an interior space of a conveyor system (e.g., an elevator shaft or interior escalator space) without physically locating themselves in the interior space. In this manner, they safety of the technician can be improved while also improving servicing response time.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A passenger conveyor diagnostic system, comprising:

a processor that stores at least one visual inspection diagnostic; and a passenger conveyor system including at least one sensor configured to capture ride quality data, the ride quality data including one or both of an image and a sound, wherein the processor applies the at least one visual inspection diagnostic to one or both of the image and the sound to generate a diagnosed status of the passenger conveyor system, and overlays the diagnosed status of the passenger conveyor system on the image.

2. The passenger conveyor diagnostic system of claim 1, wherein the processor performs the at least one visual inspection diagnostic based, at least in part, on one or both of the image and the sound, generates a video stream based on one or both of the image and sound, and overlays a results graphical user interface (GUI) on the video stream, the results GUI indicating the diagnosed status of the passenger conveyor system.

3. The passenger conveyor diagnostic system of claim 2, further comprising a mobile terminal in signal communication with one or both of the processor and the at least one sensor, the mobile terminal configured to display the video stream and the results GUI overlaid on the video stream.

4. The passenger conveyor diagnostic system of claim 3, wherein the results GUI dynamically changes in response to a detected abnormality of the passenger conveyor system reproduced during playback of the video stream.

5. The passenger conveyor diagnostic system of claim 1, wherein the passenger conveyor system is one of an elevator system or an escalator system.

6. The passenger conveyor diagnostic system of claim 5, wherein the ride quality data includes at least one of machine noise, elevator door noise, elevator car noise, and elevator car vibration, step vibration, step noise, drive chain noise, handrail noise, handrail vibration, step speed, and braking speed.

7. The passenger conveyor system of claim 2, wherein results GUI operates in a first mode that displays data configured to diagnose a given component included in the elevator system, and a second mode that displays measured metrics captured in response to performing the at least one visual inspection diagnostic.

8. The passenger conveyor system of claim 1, wherein the mobile terminal device is one of a smartphone, a computer tablet, or a smart watch.

9. The passenger conveyor system of claim 1, wherein the processor is installed in a cloud computing network.

10. The passenger conveyor system of claim 3, wherein the processor is installed in the mobile terminal device.

11. A mobile terminal device configured to diagnose a passenger conveyor system, the mobile terminal device comprising:

a memory unit that stores a visual inspection application configured to perform at least one visual inspection diagnostic;

a network interface device that establishes communication with at least one sensor installed on the passenger conveyor system; and an electronic hardware controller that applies the at least one visual inspection diagnostic to ride quality data that includes one or both of images and a sounds obtained from the at least one sensor to determine at least one diagnostic result of the passenger conveyor system, and displays the image with the least one diagnostic result overlaid thereon.

12. The mobile terminal device of claim 11, wherein the controller generates a video stream based on one or both of the images and the sounds received from the at least one sensor, and overlays a results graphical user interface (GUI) on the video stream, the results GUI displaying the at least one diagnostic result of the passenger conveyor system displayed in the video stream.

13. The mobile terminal device of claim 12, wherein the results GUI dynamically changes in response to a detected abnormality of the passenger conveyor system reproduced during playback of the video stream.

14. The mobile terminal device of claim 12, wherein the ride quality data includes at least one of elevator machine noise, elevator door noise, elevator car noise, elevator car vibration, escalator machine noise, escalator step vibration, escalator step noise, escalator step speed, escalator handrail noise, escalator handrail vibration, and escalator braking speed.

15. The mobile terminal device of claim 13, wherein the controller invokes a first mode that generates a first-type results graphical user interface (GUI) configured to display data configured to diagnose a given component included in the elevator system, and a second mode that generates a second-type results GUI configured to display measured metrics.

16. The mobile terminal device of claim 15, wherein the first-type results GUI displays at least one component name of a component included in the video stream.

17. The mobile terminal device of claim 16, wherein the measured metrics displayed by the second-type results GUI are captured in response to performing the at least one visual inspection diagnostic.

18. The mobile terminal device of claim 11, wherein the mobile terminal device is one of a smartphone, a computer tablet, or a smart watch.

19. A method of diagnosing a passenger conveyor system, the method comprising:

storing, via a processor, at least one visual inspection diagnostic; and capturing, via at least one sensor installed on the passenger conveyor system, one or both of an image and a sound, applying, via the processor, the at least one visual inspection diagnostic to one or both of the image and the sound to generate a diagnosed status of the passenger conveyor system; and overlaying, via the processor, the diagnosed status of the passenger conveyor system on the image.

20. The method of claim 19, wherein overlaying the image comprises:

performing, via the processor, the at least one visual inspection diagnostic based on one or both of the image and the sound;

generating, via the processor, a video stream based on one or both of the image and sound; and overlaying, via the processor, a results graphical user interface (GUI) on the video stream, the results GUI indicating the diagnosed status of the passenger conveyor system.

* * * * *